United States Patent [19]

Haas et al.

[11] 4,210,047

[45] Jul. 1, 1980

[54] DIE CUTTING MACHINE WITH MAGNETIC HOLDER FOR ACCURATE DIE POSITIONING

[75] Inventors: Edgar Haas, Fort Lee, N.J.; Edward Kottsieper, Dresden Mills, Me.

[73] Assignee: Herman Schwabe, Inc., Brooklyn, N.Y.

[21] Appl. No.: 921,477

[22] Filed: Jul. 3, 1978

[51] Int. Cl.[2] ..... B26F 1/40; B21D 28/04

[52] U.S. Cl. ..... 83/530; 83/554; 83/561; 83/564; 83/699

[58] Field of Search ..... 83/554, 524, 525, 527, 83/530, 532, 534, 535, 536, 541, 561, 562, 699

[56] References Cited

U.S. PATENT DOCUMENTS

| | | | |
|---|---|---|---|
| Re. 12,234 | 6/1904 | Parsons | 83/562 |
| 732,101 | 6/1903 | Morris | 83/554 |
| 781,297 | 1/1905 | Parsons | 83/699 X |
| 3,682,029 | 8/1972 | Haas et al. | 83/554 |

*Primary Examiner*—J. M. Meister
*Attorney, Agent, or Firm*—James & Franklin

[57] ABSTRACT

Interposed between the cutting surface and the pressure head is a magnetic die holder including base and die carrying sections, the former being mounted on a telescoping member which is pivotally connected to the head for vertical movement therewith and which permits movement of the holder in a plane parallel to the cutting surface. The base and die carrying sections are connected by a spring to permit the die carrying section to be vertically displaced with respect to the base section for accurate positioning of the die relative to the cutting surface. The die carrying section is also rotatable relative to the base section to permit orientation of the die at any angle with respect to the cutting surface. The die carrying section includes an electromagnet which retains the die thereon. Also located on the die carrying section are a pair of handle grips, each having a switch mounted thereon, both of which must be simultaneously actuated in order to initiate vertical movement of the pressure head. By holding the grips, the die can be displaced and rotated relative to the base section to accurately position and orient the die, and the switches can be actuated. Thus, the die can be accurately positioned and successive die cutting cycles can be performed in a completely safe and highly productive manner without the necessity of the operator removing his hands from the grips.

23 Claims, 8 Drawing Figures

5
56
60
72
58
C
72'
70
52
68
62
66
54
66
5

DIE CUTTING MACHINE WITH MAGNETIC HOLDER FOR ACCURATE DIE POSITIONING

The present invention relates to die cutting machines and, more particularly, to a die cutting machine with a magnetic holder for accurate die positioning.

Die cutting machines used for cutting patterns in sheet material are well known in the art and have taken a variety of different forms. Basically, such machines consist of a cutting surface upon which the sheet material to be cut or otherwise impressed is placed and, mounted thereabove, a pressure head. The head is vertically movable, usually by hydraulical or electrical means, towards and away from the surface. Between the pressure head and the surface is interposed a die which has thereon the outline of the pattern to be cut. The operator of the machine manually positions the die with respect to the cutting material. The pressure head is then actuated, commonly by a foot pedal or hand actuated switch, such that the pressure head moves downward to force the die into the material to be cut. At the end of its downward movement, the pressure head automatically reverses direction and returns to its original position. Thereafter, the operator repositions the die relative to the material and repeats the cutting cycle. After the entire sheet of material has been cut, same is removed and a new piece of material is placed on the cutting surface.

The overall productivity of the machine depends upon how quickly the operator can complete the successive cutting cycles. The time required to complete each cutting cycle depends on the amount of time required to position the die in the required location and thereafter to actuate the pressure head, as well as the time it takes for the pressure head to complete its stroke. Positioning and orientation of the die requires manual manipulation by the operator of the die, which may be heavy and/or bulky. In order to overcome this problem, holders upon which the dies are mounted, have been utilized. There are, however, certain mechanical requirements which must be met by such die holders. The mounting apparatus used to attach the die holder to the remainder of the machine must be easily manipulatable such that the die can be positioned as required with respect to the cutting surface at a variety of different locations and orientations. Further, while the die holder must hold the die at least a small distance above the surface of the material to be cut such that the die can be moved along the surface, it must permit movement of the die in a direction normal to the cutting surface during the vertical movement of the head.

It is necessary that the holder retain the die at a position very close to the cutting surface for accurate positioning. However, when the die is rapidly moved parallel along the cutting surface between cuts, same must be far enough away from the cutting surface to prevent swells or other irregularities in the cutting surface, such as are inherent in leather, for example, from interfering with movement of the die. Moreover, the holder must be able to meet these requirements for a variety of dies of different depths, sizes, shapes and weights.

In addition, government safety standards require that the die cutting machine be designed such that the operator's hands are never in the die area during the time when the pressure head is actuated. This rule is designed to prevent accidents which would occur if the operator inadvertently placed his hand in the path of the die movement during the actuation of the pressure head. One method of preventing such accidents is to utilize a pair of switches, each of which must be simultaneously depressed by a different one of the operator's hands to actuate the pressure head and which are located on a part of the machine which is remote from the die area. Since both of the operator's hands must be on the switches when the pressure head is actuated, they cannot be in the path of the die movement and thus accidents of this type are eliminated.

With this type of system, the operator usually must first position the die and thereafter remove his hands therefrom and place same on the switches, located on another portion of the machine, before actuation of the pressure head can take place. While this method of operation has the advantage of preventing accidents, it does not promote high productivity because of the time required in moving the operator's hands.

It is, therefore, a prime object of the present invention to prove a die cutting machine with magnetic holder for accurate die positioning which permits increased productivity in a completely safe manner.

It is a second object of the present invention to provide a die cutting machine with magnetic holder for accurate die positioning wherein the die is magnetically retained by the die carrying section of the holder which is manipulatable such that it can be displaced from its normal vertical position towards the cutting surface for more accurate die positioning.

It is a third object of the present invention to provide a die cutting machine with magnetic holder for accurate die positioning wherein the holder is mounted on a telescoping member affixed to the pressure head for vertical movement therewith.

It is a fourth object of the present invention to provide a die cutting machine with magnetic holder for accurate die positioning wherein the pressure head actuating and die holder magnetic actuating switches are located on the die carrying portion of the holder such that the operator's hands can never be in the path of the die during the actuation of the pressure head and the operator can control successive positioning and cutting operations without the necessity of relocating his hands.

It is a further object of the present invention to provide a die cutting machine with magnetic holder for accurate die positioning wherein the die carrying section of the holder is provided with a pair of handle grips for manipulating same to position and orient the die and upon which are located switches which, when simultaneously actuated, serve to initiate movement of the pressure head.

It is still another object of the present invention to provide a die cutting machine with magnetic holder for accurage die positioning wherein the electromagnet actuating switch is located in proximity to the handle grips.

In accordance with the present invention, the die cutting machine includes a support, a cutting surface mounted on the support, a pressure head mounted on the support above the cutting surface, and means effective when actuated for vertically moving the head toward and away from the surface. A die and means for holding the die are interposed between the head and the cutting surface. Means are provided for mounting the die holding means for movement in a plane substantially parallel to the cutting surface. The mounting means is connected to the pressure head for vertical movement therewith. The holding means comprises a base section connected to the mounting means and a die holding section including an electromagnet for retaining the die. Means are provided to permit displacement of the die carrying section relative to the base section towards the cutting surface prior to pressure head actuation to permit accurate positioning of the die.

Means are provided to adjust the displacement permitting means to vary the relative positions of the die carrying section with the base section so as to accommodate dies of different sizes. The displacement permitting means preferably comprises a tension spring and the means are included for varying the tension of the spring to accommodate dies of different weight.

First and second grip means are located in spaced relationship on the die carrying portion to permit the operator to manually locate, rotate and displace the die relative to the cutting surface. Preferably, first and second switch means are located on the first and second grip means, respectively, and must be actuated simultaneously to initiate head movement. Further, the electromagnetic actuating means is also preferably mounted on the die carrying section, in proximity to the grip members, such that successive die cutting cycles can be performed accurately, safely and without the necessity of relocation of the operator's hands.

The mounting means comprises a telescoping structure which is pivotally mounted to the pressure head such that the holder can be moved in a plane substantially parallel to the cutting surface but far enough above same such that the irregularities in the surface do not interfere with the movement of the die. Further, the die carrying section is rotatably mounted to the base section such that the angular orientation of the die may be varied as required. Since the telescoping structure is mounted to the pressure head, the entire assembly is movable with the head towards and away from the cutting surface.

Since the die holder is interposed between the pressure head and the cutting surface, a few inches above the cutting surface, the path of movement of the pressure head towards the cutting surface need only be a few inches. However, the depth of penetration of the die into the cutting surface must be accurately controlled. A specially designed head utilizing hydraulic and mechanical drive linkages is therefore preferably used in this connection.

To the accomplishment of the above and to such other objects as may hereinafter appear, the present invention relates to a die cutting machine with magnetic die holder, as described in the present specification and recited in the annexed claims, taken together with the accompanying drawings where like numerals refer to like parts and in which:

Figure 1:
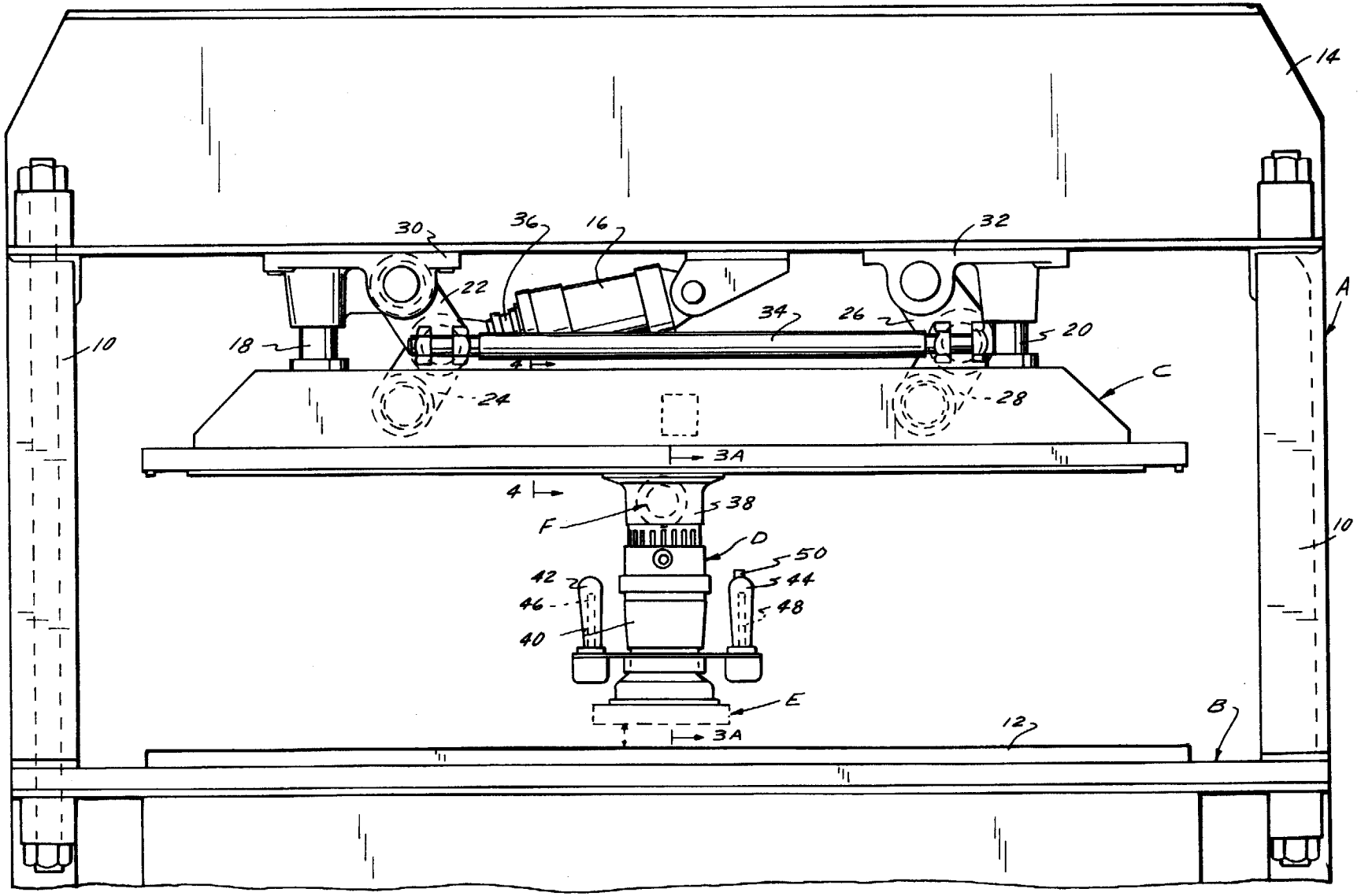
FIG. 1 is a front elevational view of the die cutting machine of the present invention, showing the pressure head in its retracted positions.

As seen in FIG. 1, the die cutting machine of the present invention comprises a frame, generally designated A, supporting a cutting surface, generally designated B, upon which a sheet of material to be cut or otherwise impressed is situated. Also mounted on frame A is a pressure head, generally designated C, which, when actuated, is movable toward and away from cutting surface B, a limited distance. Interposed between pressure head C and cutting surface B is a die holder, generally designated D, designed to support a die, generally designated E. Die holder D is mounted on pressure head C for vertical movement therewith by mounting means, generally designated F, which is not visible in FIG. 1.

Frame A comprises four upstanding members 10, only two of which are seen in FIG. 1. Members 10 support a generally horizontal table-like cutting surface B upon which is situated a flexible cutting pad 12. Upon cutting pad 12 a sheet material (not shown in FIG. 1) to be cut or otherwise impressed is located. Connected across the top of upstanding members 10 is a cross-member 14 to which pressure head C is mounted. Pressure head C preferably has a structure which is similar to the structure of the pressure head disclosed in U.S. Pat. No. 3,682,029, issued Aug. 8, 1972, entitled Balanced and Double Action Cutting Apparatus, which is assigned to the assignee herein. This head has hydraulic and mechanical linkages which operate together to assure that each stroke has the same bottom limit and thus the die has the same penetration depth for each cut.

Pressure head C is hydraulically driven, by means of a hydraulic cylinder 16, between a retracted position, as shown in FIG. 1, and an extended or a die cutting position. The pressure head moving mechanism includes a pair of vertical guide members 18, 20, which are connected between cross-member 14 and pressure head C, to guide the vertical movement of pressure head C relative to cross-member 14. Adjacent each of the vertical guide members 18, 20 are a pair of toggle arms 22, 24, and 26, 28, respectively. Toggle arms 22 and 26 are pivotally mounted to cross-member 14 by means of brackets 30, 32. Toggle arm 24 is pivotally mounted at one end thereof to toggle arm 22 and at the other end thereof to pressure head C. In a similar manner, toggle arm 28 is pivotally mounted to toggle arm 26 at one end thereof and to pressure head C at the other thereof. The junction between toggle arms 22 and 24 is operably connected to the junction between toggle arms 26 and 28 by means of a rod 34, such that each pair of toggle arms move simultaneously. Hydraulic cylinder 16 is provided with a piston rod 36 extending therefrom which is connected to the junction between toggle arms 22 and 24.

When cylinder 16 is actuated, piston rod 36 is extended such that the toggle arms 22 and 24 become substantially vertically aligned. Because of connecting rod 34, both sets of toggle arms 22 and 24, and 26, 28 must move simultaneously. Thus, the actuation of cylinder 16 causes both sets of toggle arms to be substantially vertically aligned, thereby moving pressure head C towards cutting surface B a distance accurately defined by the length of the aligned toggle arms. The movement of pressure head C towards cutting surface B causes die holder D to force die E through the sheet material on cutting surface B, so as to cut or otherwise impress the material as required. Thereafter, cylinder 16 is automatically actuated to retract piston rod 36, thereby causing the toggle arm pairs to return to the position depicted in FIG. 1 and causing the pressure head to return to the retracted position.

Die holder D comprises a base section 38 which is supported by mounting means F in a vertical position stationary with respect to pressure head C. Thus, base section 38 of die holder D is designed to move in the vertical direction along with pressure head C. Further, support means F, the structure of which is explained in detail below, permits die holder D to be moved in a plane parallel to cutting surface B anywhere under pressure head C. This latter movement is necessary in order to position die E at various locations along the cutting surface B.

A die carrying section 40, of die holder D, is rotatably and linearly moveably mounted on base section 38. Supported on die carrying section 40 are a pair of grip members 42, 44 each of which has mounted thereon a switch, shown in the drawing as a pair of depressable triggers 46, 48. As explained in detail below, simultaneous depression of triggers 46 and 48 will cause actuation of the pressure head drive cylinder 16. Also situated on grip 44 is a switch 50 which, when normally closed, energizes an electromagnet situated within die carrying section 40 so as to retain die E to the bottom thereof. Grip members 42 and 44 can be manipulated so as to move die holder D in a plane substantially parallel to the cutting surface B and to displace and rotate die carrying section 40 with respect to base section 38. Thus, die E can be moved to any angular orientation with respect to the cutting surface. The displacement of die carrying section 40 with respect to base section 38 permits the operator to place the die E on the cutting surface to accurately position same prior to actuation of the pressure head C.

Since the operator can manipulate the die and actuate the pressure head while holding the grip members, a number of successive cutting operations can be performed safely without removing the operator's hands from grips 42, 44. After the sheet material is positioned, on the cutting surface, the operator grasps the grip members and manipulates die holder D such that it is above die E, which is placed anywhere on the sheet. The operator actuates button 50 so as to energize the electromagnet within die carrying section 40 to cause die E to adhere to the bottom of die holder D. Holding the grips, one in each hand, the operator positions the die E over the location on the sheet material at which the first cut is to be performed and moves the die into the desired angular orientation. This is achieved by moving die holder D in a plane substantially parallel to the cutting surface and rotating die carrying section 40 with respect to base section 38. The operator then presses down on the grip members to displace die carrying section 40 relative to base section 38 such that the die E rests on the material to be cut in order to accurately position same. The operator simultaneously depresses triggers 46 and 48 to actuate the pressure head drive cylinder. Actuation of the pressure head drive cylinder 16 causes the pressure head to move to its extended position, thereby forcing the die through the sheet material to an accurate depth of penetration defined by the extension of the toggle arms. After the head reaches the extended position, completing the cut, it automatically returns to its retracted position. As a safety measure, the pressure head drive cylinder 16 cannot be reactuated until the head has returned to the retracted position and the triggers have been released and again simultaneously depressed. Before the next depression of triggers 46 and 48, the operator will manipulate grips 42 and 44 so as to reposition, reorient and displace the die E in position for the next successive cut in the sheet material. When this is completed, the triggers are again simultaneously depressed and a second cut is performed. Successive cuts are made with the die being repositioned, reoriented and displaced between each cut, until the entire material has been cut by successive cutting operations. The sheet material is then removed and a new sheet positioned on cutting surface B.

Figure 2:
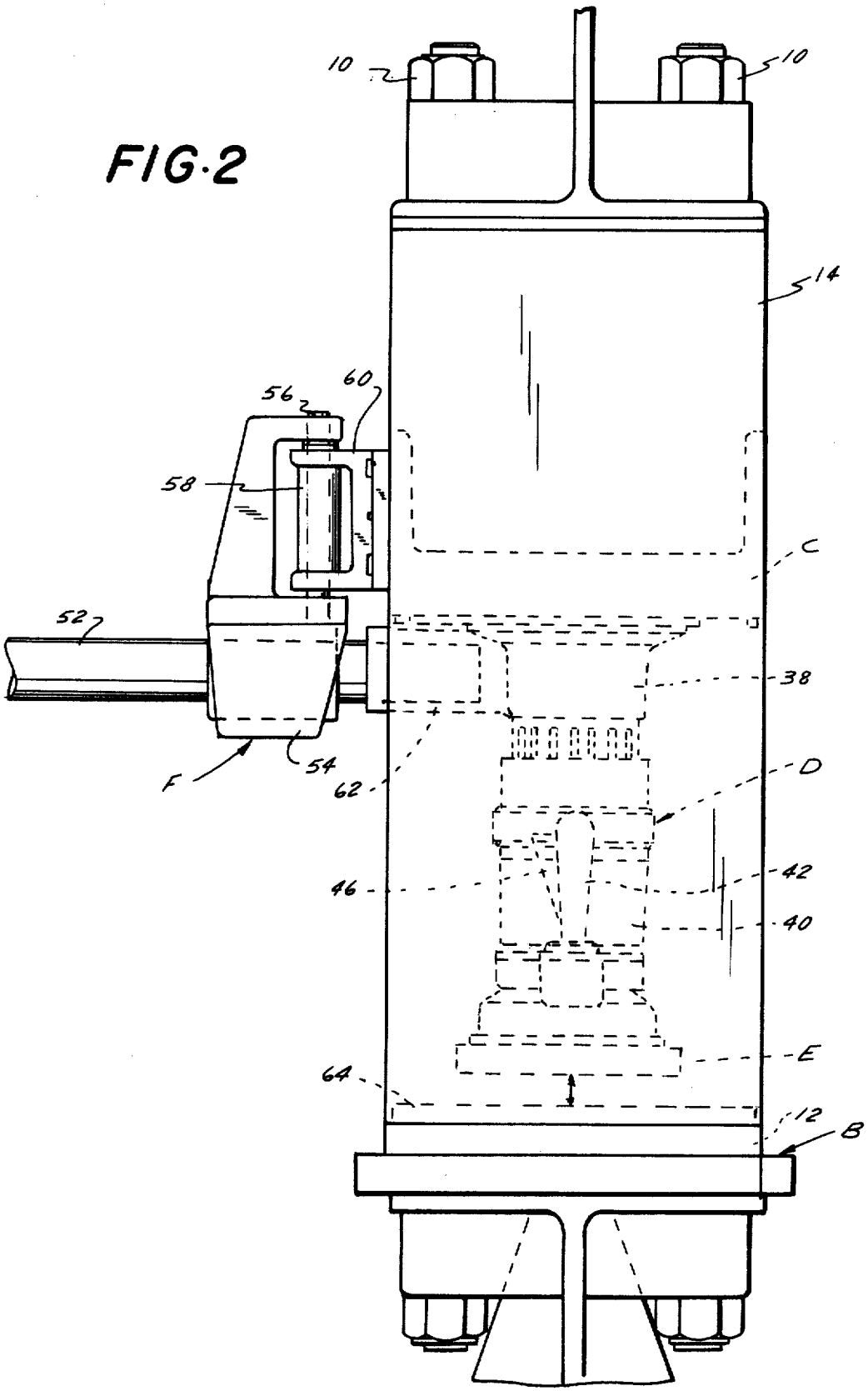
FIG. 2 is a side view of the die cutting machine of the present invention, showing the mounting means for the die holder.

The structure of mounting means F is illustrated in FIG. 2. Mounting means F comprises a rigid tubular member 52 supported between the end thereof by the lower portion of a bracket 54. The upper portion of bracket 54 has a bifurcated or "U" shape, with a shaft 56 extending between the extended arms of the "U". Rotatably mounted about shaft 56 is a tubular member 58, connected to a second bifurcated or "U"-shaped bracket 60, which is in turn bolted to the back of pressure head C. Brackets 54 and 60 permit tubular member 52 to be pivoted with respect to pressure head C while supporting tubular member 52.

Tubular member 52 is connected to a second tubular member 62, of larger diameter, in telescoping fashion. Tubular member 62 is, in turn, rigidly connected to base section 38 of die holder D. By means of tubular members 62 and 52, and brackets 54 and 60, die holder D is movable virtually anywhere below pressure head C in a plane slightly above and substantially parallel to cutting surface B. This is illustrated in FIG. 6.

Figure 6:
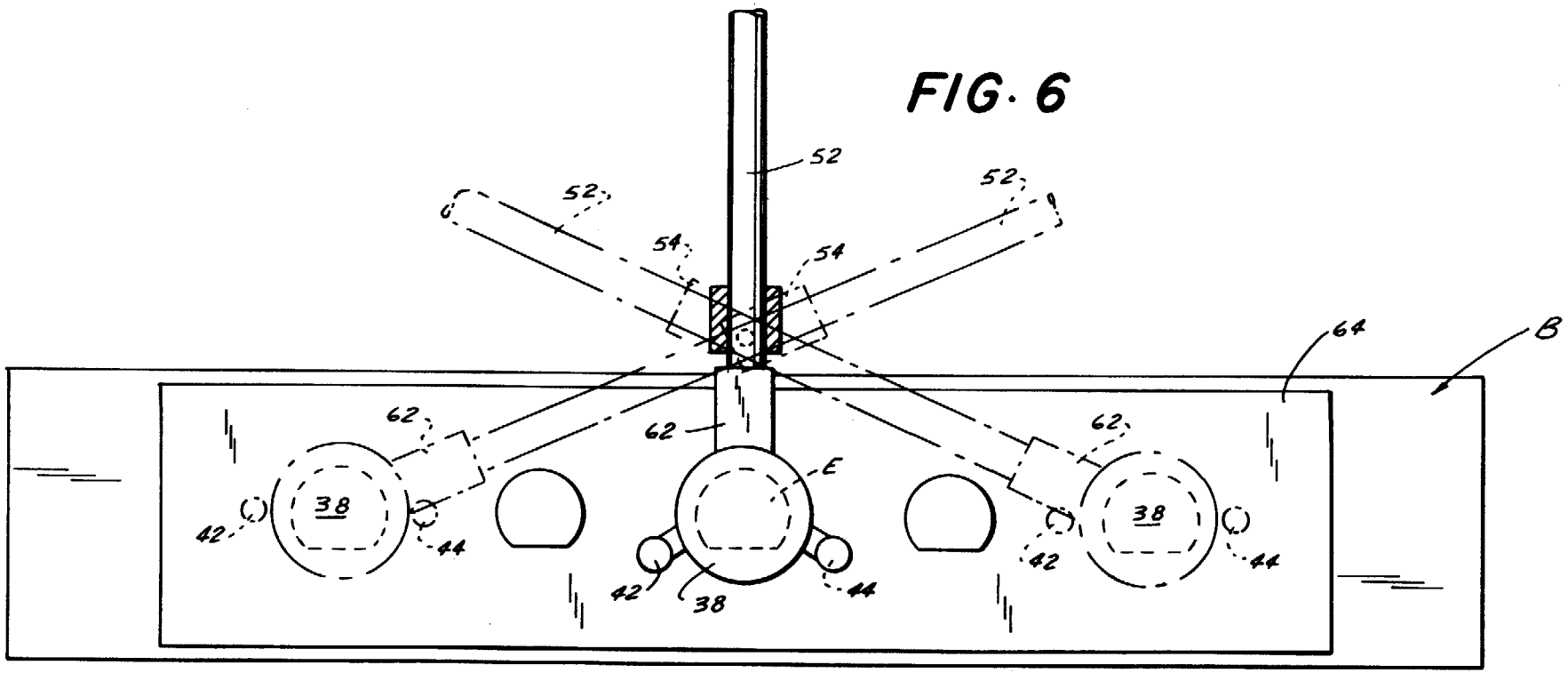
FIG. 6 is a schematic view of the die holder and mounting assembly in various positions as it is seen from above.

FIG. 6 is a schematic representation showing how the die holder D can be positioned and oriented to perform five separate cutting operations, along the length of a sheet of material 64 situated on surface B. It is to be noted that in each position the flat side of die E is shown as oriented to be substantially parallel to the front edge of sheet material 64. However, it should be appreciated that die carrying section 40 can be rotated relative to base section 38 such that any angular orientation of the die with respect to the cutting surface can be obtained. Viewed in this manner, the reason for designing die carrying section 40 of die holder D to be rotatably movable with respect to base section 38 of the die holder D can be appreciated. In FIG. 6, die holder D is shown in three positions, the two end positions and the middle position of the five cuts illustrated. From this drawing it is clear that not only do tubular sections 52 and 62 telescope with respect to each other, but that tubular member 52 is movable with respect to bracket 54. That is, tubular member 52 can be pulled through bracket 54 in order to permit die holder D to be displaced a distance from bracket 54 greater than the telescoping ability of tubular members 52 and 62, so as to permit placement at the extreme ends of sheet material 64.

Figure 4:
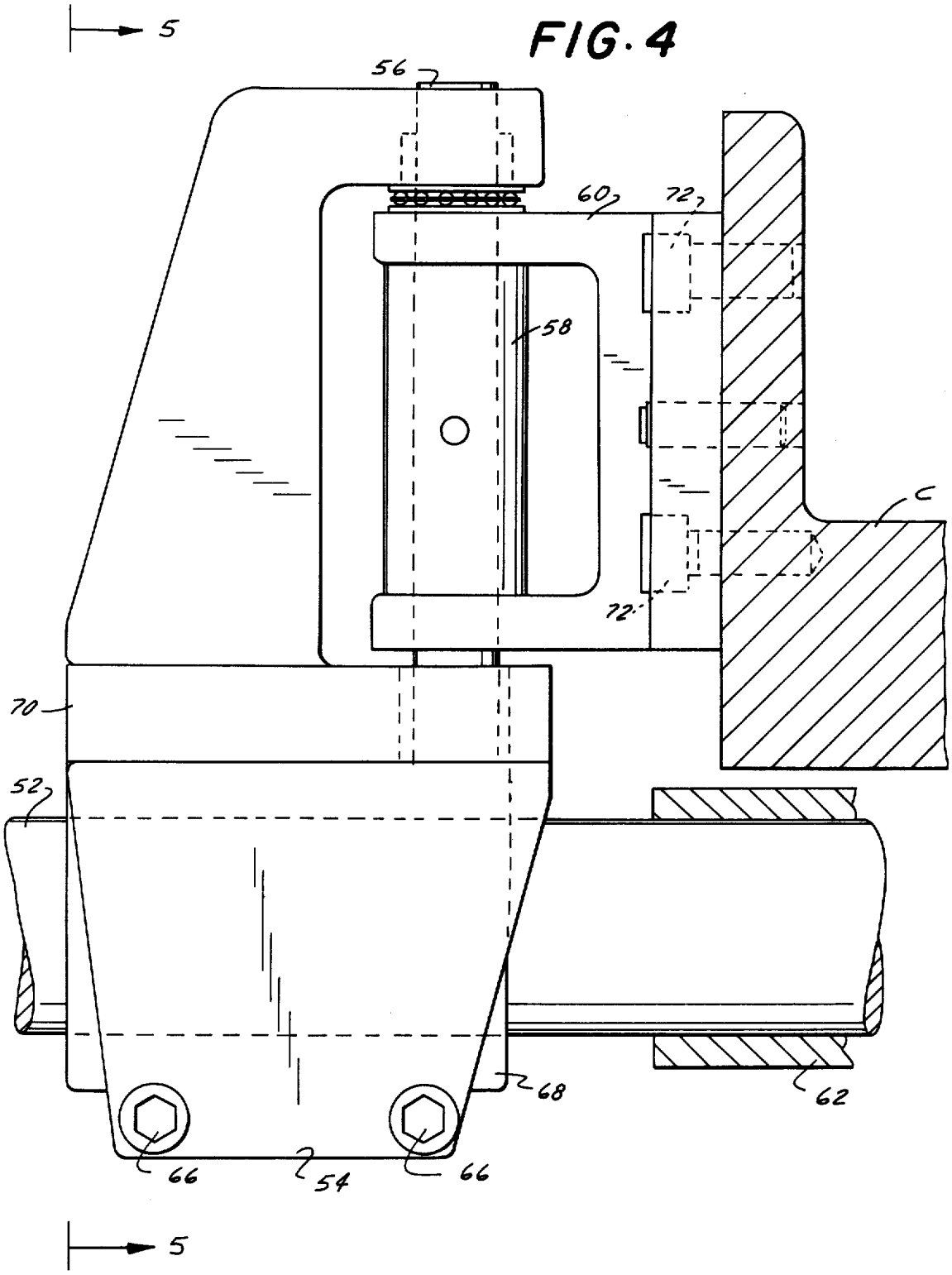
FIG. 4 is an enlarged side view of the mounting means.
Figure 5:
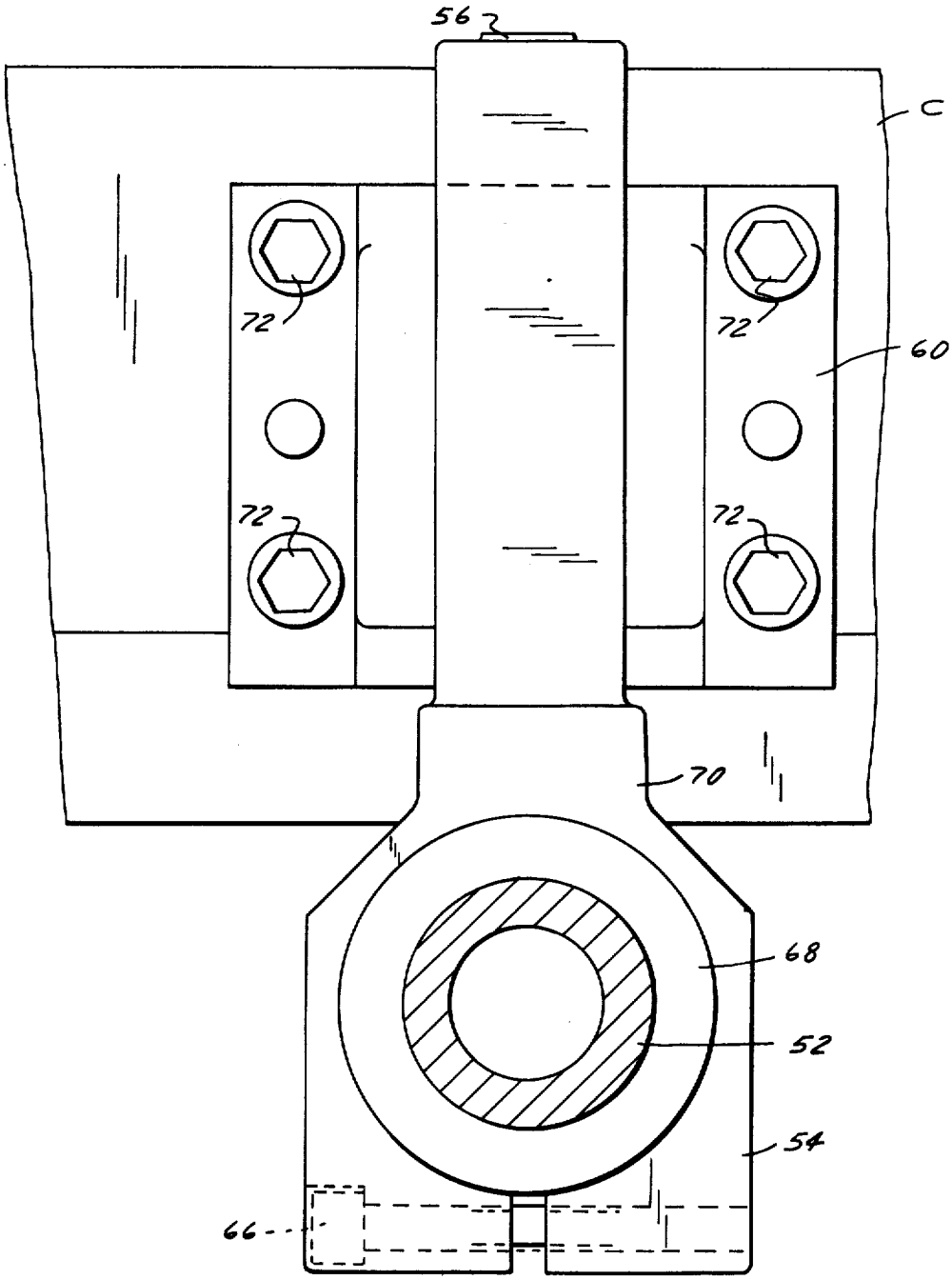
FIG. 5 is a rear view of the mounting means as seen along line 5—5 of FIG. 4.

FIGS. 4 and 5 show the swivel assembly of mounting means F in greater detail. As will be appreciated from FIG. 5, which is a rear view of the swivel assembly, the lower portion of bracket 54 has a bifurcated part with a bore therethrough. At the bottom of the bore is provided a pair of bolts 66 which are utilized to adjust the relative positions of the bifurcated parts. Tubular section 52 is situated within a ball bushing collar 68 which acts as a bearing to permit tubular section 52 to move relative to bracket 54. This permits die holder D to be linearly displaced with respect to bracket 54 a distance larger than the telescoping mechanism between tubular section 62 and tubular section 52 would permit. The upper part of the lower portion of bracket 54 tapers to form a neck 70, which forms the bottom of "U"-shaped upper section of bracket 54. Bracket 60, which is pivotally mounted to bracket 54 by means of shaft 56, is rigidly mounted on pressure head C by means of bolts 72.

Figure 3A:
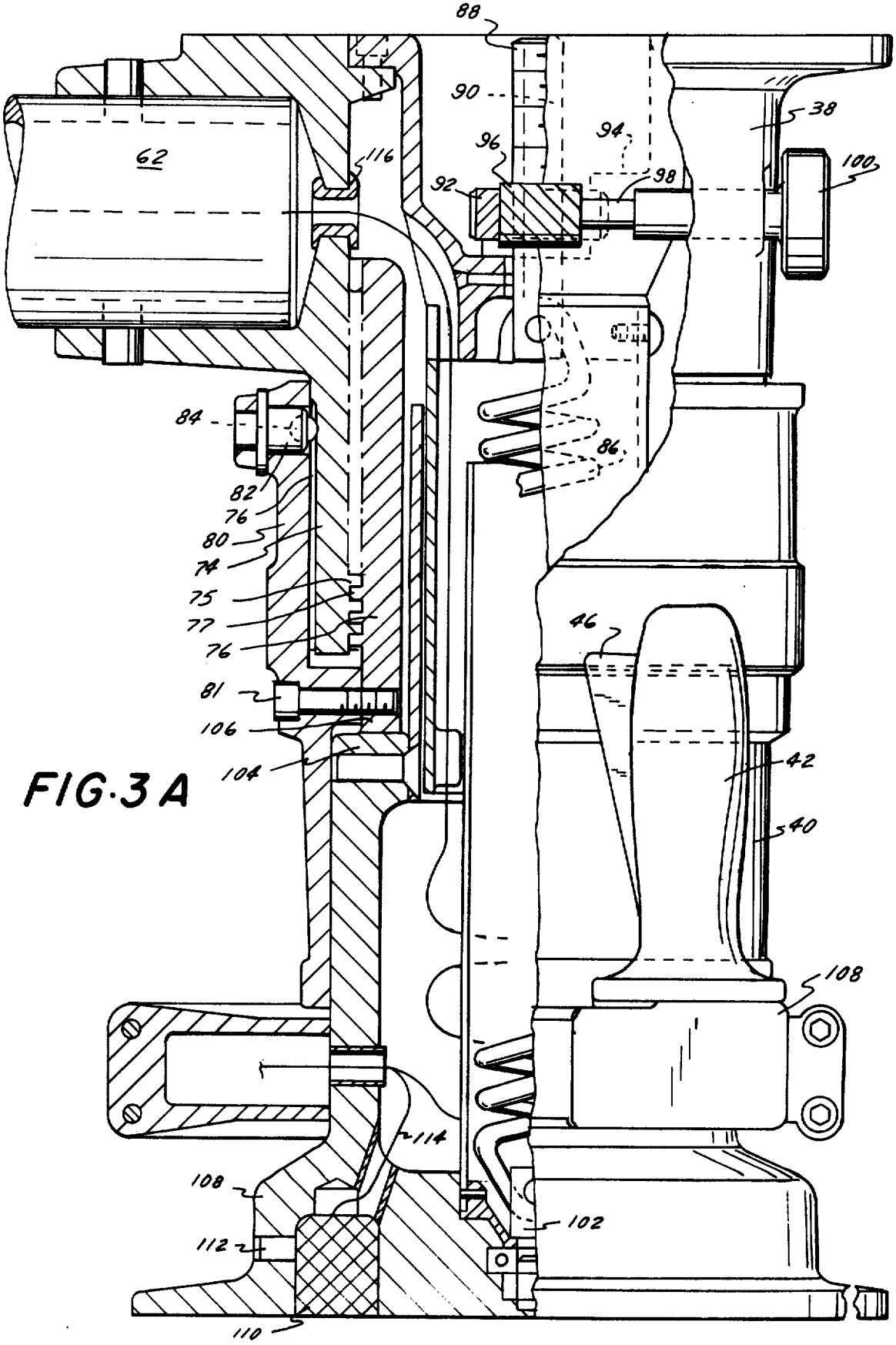
FIGS. 3A and 3B are enlarged, partially cut-away side view and top views respectively of the die holder, as seen when the pressure head is in the cutting position.
Figure 3B:
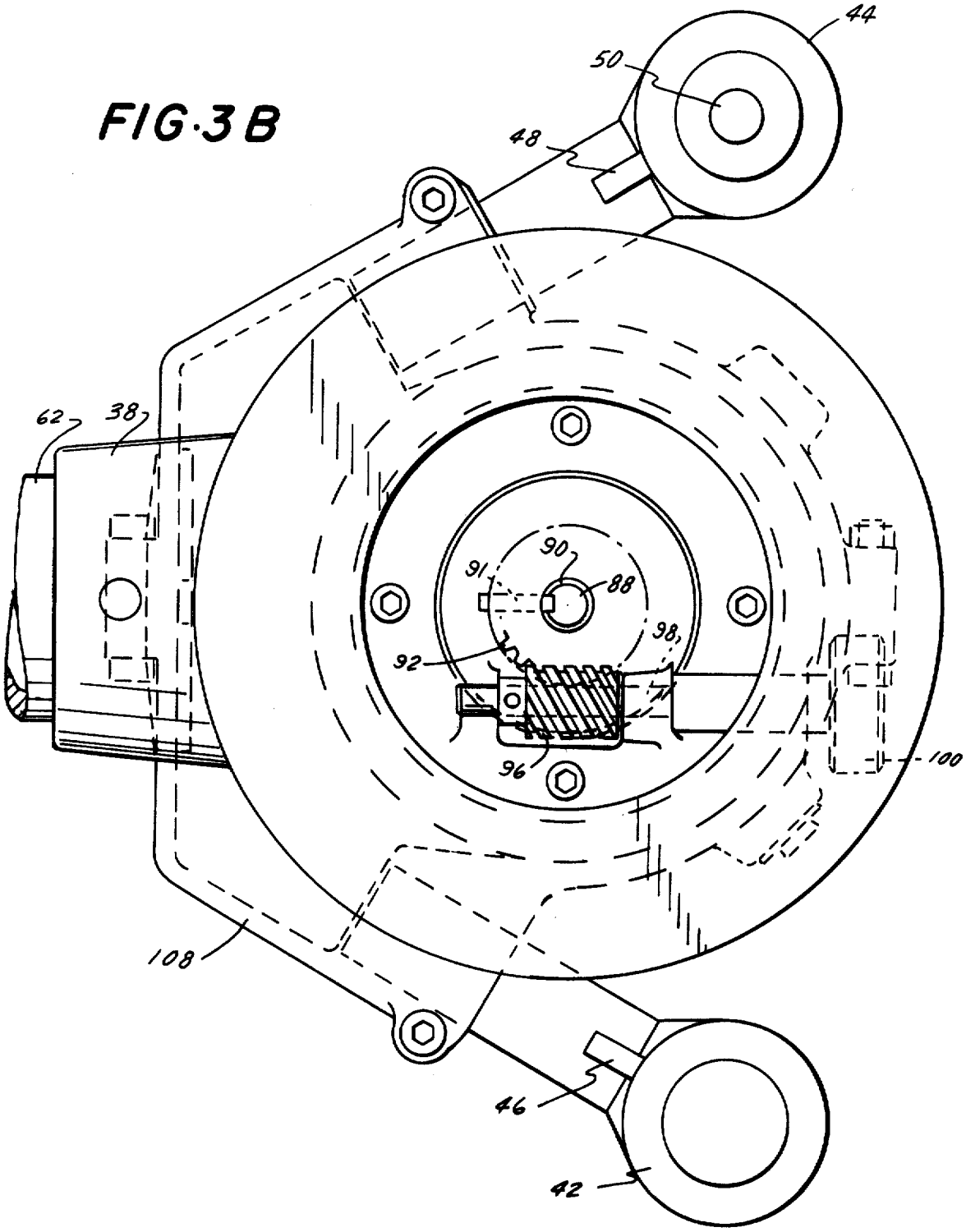

FIGS. 3A and 3B show the structure of die holder D. Tubular member 62 is rigidly connected to base section 38 of die holder D. Base section 38 includes a downwardly extending hollow cylindrical member 74 mounted on member 62. Member 74 has a plurality of longitudinally extending grooves 76 spaced along the outer surface thereof, only one of which is shown. On the exterior surface of member 74 are screw threads 75. Base section 38 also includes a second hollow cylindrical member 78, situated within member 74 and having screw threads 77 in meshing engagement with threads 75 on member 74. A collar member 80, also a part of base section 38 is affixed to member 76 by means of screws 81, only one of which is shown. The upper portion of collar member 80 has a radial bore 82 within which is situated a spring loaded ball bearing 84 cooperating with grooves 76 on member 80 in detent fashion. As will now be appreciated, collar member 80, and member 76 fixed thereto, can be rotated as a unit with respect to cylindrical member 74. This relative rotation will cause member 76 to move in a vertical direction with respect to member 74. Since, as explained below, the carrying portion 40 is normally urged against the lower portion of member 76, the vertical displacement of member 76 relative to member 80 will cause die carrying section 40 to be vertically displaced relative to member 80 and thus relative to the portion of base section 38 mounted on member 62.

Spring loaded detent member 84 cooperates with grooves 76 on the outer surface of member 80 such that member 76 is detented into any one of a number of different rotational positions relative to member 80. Each detented position represents a different relative vertical displacement of die carrying section 40 relative to member 80. In this manner, the distance between the die carrying surface of section 40 and the cutting surface can be varied to accommodate dies of different sizes.

Die carrying section 40 of die holder D is operably connected to base section 38 by means of a tension spring 86. Spring 86, at its upper end, is connected to an externally threaded screw 88 having a longitudinal groove 90 therein. Groove 90 is keyed to base section 38 by protrusion 91 to prevent rotation of screw 88. An internally and externally threaded worm gear 92 is rotatably mounted around screw 88 and held in position by housing 94. Rotation of gear 92 will thus cause screw 88 to move in the vertical direction. Gear 92 meshes with worm 96 fixed to shaft 98 which, in turn, is mounted on control knob 100. Thus, the rotation of knob 100 serves to adjust the tension of spring 86 which acts as a counterbalance for the weight of the die. The adjustability of the tension on spring 86 therefore permits the apparatus to function with dies of a variety of different weights.

The lower portion of spring 86 is connected to die carrying section 40 by a rotatable bracket 102 to provide for rotation between the sections to facilitate angular orientation of the die. Die carrying section 40 is cylindrical in shape with an opened top end to receive the spring 86 therein. The top edge 104 of cylindrical section 40 is normally urged against the lower rim of member 76. When section 40 is vertically displaced by pushing down on hand grips 42, 44, spring 86 is extended and the die placed on the cutting surface. When the pressure head is actuated, base section 38 moves towards die carrying section 40 until rim 106 engages edge 104. Further movement of the pressure head causes base portion 38 to exert a downward force on die carrying section 40 to push the die through the material to be cut.

Grip member 42, 44 are mounted on a support ring 108 which, in turn, is affixed to the outer surface of die carrying section 40. Members 42, 44 are spaced from the exterior surface of section 40 to permit easy access thereto.

A shell 108 is provided in die carrying section 40 in order to house an electromagnet 110 which is held therein by means of a set screw 112. Electromagnet 110 is connected to an electrical source (not shown), through switch 50 (not shown in this drawing) by means of cables 114. The hollow portion of section 40 permits the cables from triggers 46 and 48, as well as from switch 50, to be connected through section 38 and pass through a grommet 16 adjacent member 62 and thereafter extend down tubular members 62 and 52 for connection to the remainder of the electrical system, described in detail below. In this manner, no cables are situated outside the die holder D to get in the way of the operation of the machine.

It should be appreciated that the die holder D is illustrated in FIG. 3 in its non-extended state. However, when section 40 is displaced relative to section 38 by extending spring 86, there will be a distance of a few inches between the sections. It will therefore be appreciated that pressure head C need only move a distance equal to the displacement of section 40 relative to section 38 plus a distance equal to the thickness of the material to be cut. Therefore, pressure head C need only move a few inches and this movement can take place in a relatively short amount of time so as to reduce the amount of time necessary for each cutting cycle.

Figure 7:
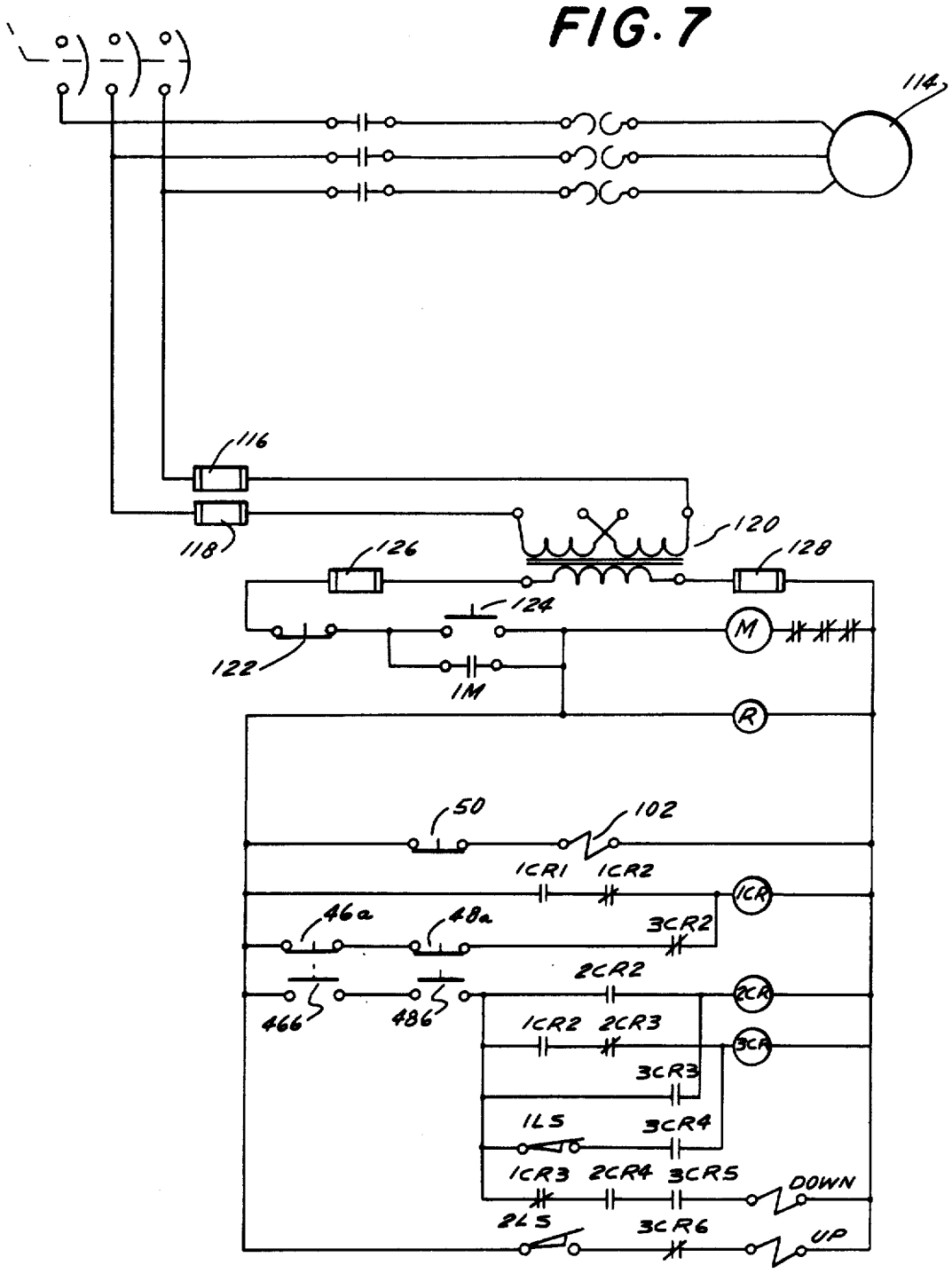
FIG. 7 is a schematic diagram of the electrical system of the present invention.

FIG. 7 shows a schematic diagram of the electrical system of the die cutting machine of the present invention. A conventional three-pole motor 114 is utilized to drive the compressor (not shown) which provides the necessary hydraulic pressure to drive pressure head cylinder 16 to move pressure head C between its retracted and extended positions. Motor 114 is connected by means of fuses 116 and 118 to one side of a transformer 120. The other side of transformer 120 is connected to an "off" pushbutton switch 122, shown in the off position, and an "on" pushbutton switch 124, shown in the on position, which energize a relay M. Normally open relay contacts 1 M are situated in parallel with switch 124 to latch the motor on after button 124 is depressed. A power lamp R is provided to indicate that the motor is energized. Fuses 126 and 128 are connected to both terminals of transformer 120.

Triggers 46 and 48 are each shown to have two sets of contacts 46*a*, 46*b* and 48*a*, 48*b*, respectively. Contacts 46*a* and 48*a* are normally closed, thereby energizing relay 1CR, so as to open normally closed relay contacts 1CR3. Contacts 1CR3 are located in series with the contacts 2CR4 and 3CR5 which when all are closed energize motor 114 to move the pressure head C from the retracted to the extended (down) direction. Relay 1CR is latched into the energized condition through contacts 1CR1 and normally closed contacts 2CR1, to prevent the downward movement of head C until switches 46 and 48 are simultaneously depressed.

When switches 46 and 48 are simultaneously depressed, contacts **46*b* and 48*b* close and contacts 46*a* and 48*a* open. When this occurs, relay 3CR is energized, relay contacts 1CR2 being closed because relay 1CR is latched into the energized condition and contacts 2CR3 being normally closed. The energization of relay 3CR causes contacts 3CR3 and 3CR4 to close and contacts 3CR2 to open. The closing of contacts 3CR3 energizes relay 2CR which, in turn, causes contacts 2CR2 to close thereby latching relay 2CR in the energized condition and contacts 2CR1 to open, thereby deenergizing relay 1CR. Contacts 2CR3 are also opened. Relay 3CR will thus remain energized only as long as limit switch 1LS remains closed. Limit switch 1LS will remain closed until the pressure head reaches its extended position. Thus, relays 1CR3, 2CR4, and 3CR5 are all closed and the pressure head will proceed downward until limit switch 1LS opens, at which time relay 3CR is de-energized thus opening contacts 3CR5 to stop the downward movement of the pressure head. Contacts 3CR4 (now opened) prevent reenergization of relay 3CR as the pressure head moves in the upward direction. Contacts 3CR3, now opened, cut off the alternate path of energization of relay 2CR**.

As relay 3CR is de-energized, normally closed contacts 3CR6 close. Limit switch 2LS, which is normally closed, and is held open by the pressure head until it reaches its extended position, is now closed and the motor 114 drives the hydraulic compressor in order to move the pressure head in the upward position. Once pressure head C reaches the retracted position, limit switch 2LS is again held open and movement of the pressure head is terminated.

It should be appreciated the downward movement of the pressure head cannot take place until relay 3CR is energized. Relay 3CR can be energized only if relay 1CR is energized and relay 2CR is de-energized. However, relay 1CR cannot be energized until both of the switches 46 and 48 are released. Therefore, after the pressure head returns to its retracted position, a new cutting cycle can not be initiated until both of the triggers 46, 48 are released and thereafter simultaneously depressed. Thus, for safety reasons, a new cutting cycle can not be initiated accidently.

Electromagnet 102 is connected in series with normally closed pushbutton 50 which connects the magnet to a DC power supply so as to energize same to retain die E to the under-side of die holder D. Upon depression of switch 50, the electromagnet 102 is de-energized to permit changing of the dies.

It should, therefore, be appreciated that the present invention is a die cutting machine which permits increased productivity while assuring the operator's safety. The increased productivity is achieved by permitting consecutive cutting cycles to be performed without relocation of the operator's hands and through the use of a "short stroke" pressure head. Mounting means are provided which permit the operator to position and orient the die holder, and thus the die, at any location on the material, to be cut. The same grips which permit manipulation of the die holder also contains the pressure head actuating triggers, which require simultaneous actuation to provide head movement. In addition, a pushbutton switch in proximity to the grips is provided to de-energize or energize the electromagnetic die retaining means. Since the operator must have both hands on the triggers for head actuation, there is no possibility of an accident because his hands are then out of path of movement of the pressure head.

While only a single preferred embodiment of the present invention has been disclosed herein for purposes of illustration, it is clear that many modifications and variations could be made thereto. It is intended to cover all of these variations and modifications all within the scope of the present invention as defined by the annexed claims.

What is claimed is:

1. A die cutting apparatus or the like comprising a support, a cutting surface mounted on said support, a pressure head mounted on said support above said surface, means for moving said head toward and away from said surface, a die, means, interposed between said head and said surface, for holding said die, and means for mounting said die holding means to said pressure head for movement therewith, said holding means comprising: a base section connected to said mounting means, a die carrying section comprising means for magnetically retaining said die and means for permitting movement of said die carrying section relative to said base section in the direction of head movement so as to facilitate accurate positioning of said die, said movement permitting means comprising; a spring operably connected between said sections to permit linear displacement therebetween and means for permitting relative rotation between said sections, said relative rotation permitting means comprising a rotatable bracket connecting said spring to said die carrying section.

2. The apparatus of claim 1, said base section comprises means for adjusting the effective length thereof so as to adjust the relative position of said sections when said die carrying section is in the non-displaced state.

3. The apparatus of claim 2, wherein said base section comprises first and second parts having intermeshing threads, said parts being rotatable relative to each other so as to adjust the effective length of said base section.

4. The apparatus of claim 3, further comprising means for varying the tension on said spring.

5. The apparatus of claim 4, wherein said mounting means comprises means for permitting movement of said base section relative to said head in a plane substantially parallel to said surface.

6. The apparatus of claim 5, wherein said mounting means comprises means for pivoting said base section relative to said head.

7. The apparatus of claim 6, wherein said mounting means further comprises means for pivoting said base section relative to said head.

8. The apparatus of claim 7, wherein said movement permitting means comprises telescoping means.

9. A die cutting apparatus or the like comprising a support, a cutting surface mounted on said support, a pressure head mounted on said support above said surface, means for moving said head toward and away from said surface, a die, means, interposed between said head and said surface, for holding said die, and means for mounting said die holding means to said pressure head for movement therewith, said die holding means comprising a base section connected to said mounting means and a die carrying section comprising means for magnetically retaining said die, and means for permitting displacement of said die carrying section relative to said base section in the direction of head movement so as to facilitate accurate positioning of said die, said base section comprising first and second parts having intermeshing threads, said parts being rotatable relative to each other so as to adjust the effective length of said base section.

10. A die cutting apparatus or the like comprising a support, a cutting surface mounted on said support, a pressure head mounted on said support above said surface, means for moving said head toward and away from said surface, a die, means, interposed between said head and said surface, for holding said die, and means for mounting said die holding means to said pressure head for movement therewith, said holding means comprising a base section connected to said mounting means, said base section comprising first and second parts, and a die carrying section comprising means for magnetically retaining said die, and means for permitting displacement of said die carrying section relative to said base section in the direction of head movement so as to facilitate accurate positioning of said die, said base section comprising means for adjusting the effective length thereof so as to adjust the relative position of said sections when said die carrying section is in the non-displaced state, said adjusting means comprising intermeshing threads on said first and second parts to permit said parts to be rotatable relative to each other so as to adjust the effective length of said base section.

11. A die cutting apparatus or the like comprising a support, a cutting surface mounted on said support, a pressure head mounted on said support above said surface, means for moving said head along a path toward and away from said surface, a die, means, interposed between said head and said surface, for holding said die, and means for mounting said die holding means in a position adjacent said pressure head for movement therewith, said mounting means comprising means for rotatably mounting said die holding means to said pressure head, said rotatable mounting means being located outside said path of movement of said head, such that force from said pressure head is applied directly to said die holding means.

12. The apparatus of claim 11, wherein said mounting means further comprises a member operably connecting said die holding means and said rotatable mounting means.

13. The apparatus of claim 12, wherein said member is a telescoping member.

14. The apparatus of claim 13, wherein said telescoping member is situated in a plane substantially perpendicular to said path of movement of said pressure head.

15. The apparatus of claim 12, wherein said die holding means comprises a base section supported by said connecting member and a die carrying section comprising means for magnetically retaining said die.

16. The apparatus of claim 15, further comprising means for permitting displacement of said die carrying section relative to said base section in the direction of head movement so as to facilitate accurate positioning of said die.

17. The apparatus of claim 16, wherein said displacement permitting means comprises a spring operably connected between said sections to permit linear displacement therebetween.

18. The apparatus of claim 17, wherein said displacement permitting means comprises means for permitting relative rotation between said sections.

19. The apparatus of claim 4, said base section comprises means for adjusting the effective length thereof so as to adjust the relative position of said sections when said die carrying section is in the non-displaced state.

20. The apparatus of claim 17, said base section comprises means for adjusting the effective length thereof so as to adjust the relative position of said sections when said die carrying section is in the non-displaced state.

21. The apparatus of claim 17, further comprising means for varying the tension on said spring.

22. The apparatus of claim 16, wherein said displacement permitting means comprises means for permitting relative rotation between said sections.

23. The apparatus of claim 16, said base section comprises means for adjusting the effective length thereof so as to adjust the relative position of said sections when said die carrying section is in the non-displaced state.

* * * * *